United States Patent [19]

Babb

[11] 4,115,667

[45] Sep. 19, 1978

[54] LOUDSPEAKER VOICE COIL BEARING

[75] Inventor: Burton A. Babb, Dallas, Tex.

[73] Assignee: Babbco, Ltd., Dallas, Tex.

[21] Appl. No.: 669,315

[22] Filed: Mar. 22, 1976

Related U.S. Application Data

[63] Continuation-in-part of Ser. No. 372,074, Jun. 21, 1973, Pat. No. 3,983,337.

[51] Int. Cl.[2] ..... H04R 9/04

[52] U.S. Cl. ..... 179/115.5 VC

[58] Field of Search ..... 179/115.5 VC

[56] References Cited

U.S. PATENT DOCUMENTS 2,235,654 3/1941 Steers ..... 179/115.5

3,201,529 8/1965 Surh ..... 179/115.5

*Primary Examiner*—George G. Stellar

*Attorney, Agent, or Firm*—Hubbard, Thurman, Turner, Tucker & Glaser

[57] ABSTRACT

A dynamic loudspeaker which operates over a wide band of audio frequencies is disclosed. The speaker includes a speaker cone and voice coil structure of very low mass. A configuration of ribs on the cone and dust cap is important to both high and low frequency performance. The rear suspension for the speaker is a bearing on the voice coil structure. The bearing encircles and slides on the magnetic center pole of the speaker. A method of fabricating the low mass coil structure is disclosed, including forming the bearing surface by heat shrinkage of a low friction tape.

21 Claims, 19 Drawing Figures

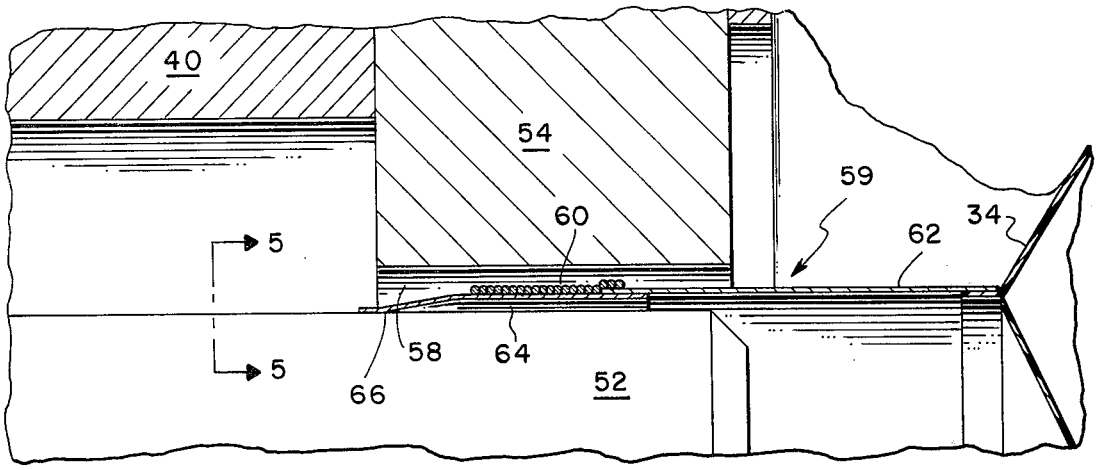
FIG. 4
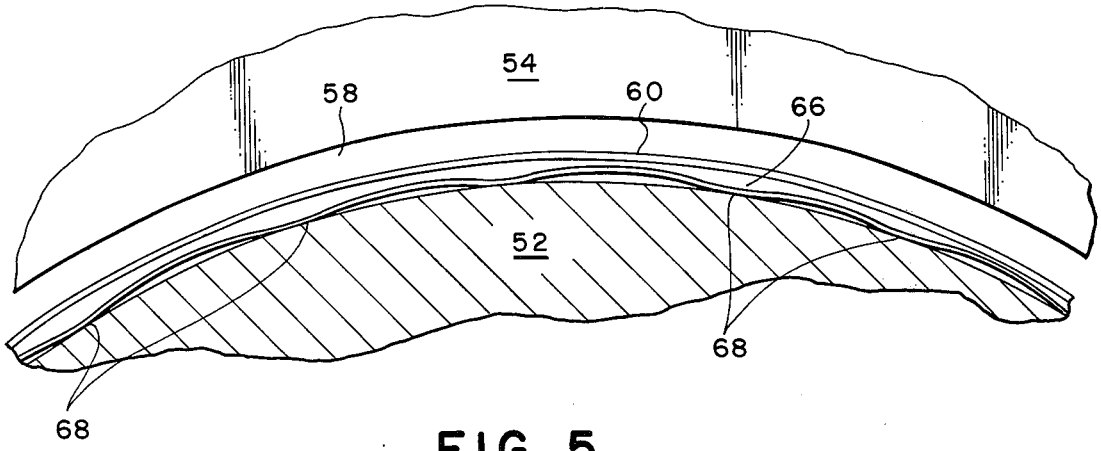
FIG. 5
FIG. 6
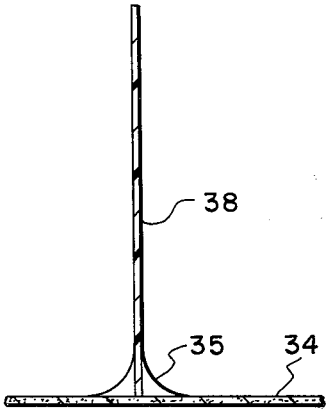

LOUDSPEAKER VOICE COIL BEARING

This application is a continuation-in-part of Application Ser. No. 372,074, entitled "Broad Band Acoustic Speaker," filed June 21, 1973, now U.S. Pat. No. 3,983,337 and incorporates by reference all of the features described therein.

This invention relates generally to loudspeakers, and more particularly, to a dynamic loudspeaker which operates over a wide band of audio frequencies.

A convention high fidelity loudspeaker system employs multiple drivers, each one a specialized transducer for a portion of the audible frequency spectrum. The electrical input signal to the system is divided among the various drivers by electronic filters known as cross-over networks.

In accordance with the present invention, a single driver acts as a transducer for substantially all of the audible spectrum. Such a speaker can yield several benefits. It may be lower in cost, more compact, and less complex. The sound can be improved by eliminating the distortion which exists around the cross-over frequencies between multiple drivers.

A number of factors are responsible for the full-range response of the speaker according to the present invention. A plurality of improved ribs of the type disclosed and claimed in the above referenced application are provided on the speaker cone and dust cap and make it possible to employ a cone of sufficiently light paper to move at high frequencies, yet rigid enough to produce low frequencies at higher power loads. The ribs considerably expand the area of the cone and dust cap which radiates high frequencies and assure the phase coherence of the radiation from these areas. The conventional rear suspension for the moving parts of a speaker, the "spider", has been replaced by an improved bearing of the type also disclosed and claimed in the above referenced patent application which offers several advantages. The mass of the spider and its associated high frequency impedance are eliminated. The rear suspension of the present invention has an infinite compliance, and permits large cone excursions heretofore unobtainable in a small speaker, thus considerably enhancing low frequency performance.

The transducer of the present invention is also quite efficient. In the design of a speaker system for an enclosure of a specified size, there is a trade-off between the midrange efficiency of the system and its frequency response, or bandwidth. In the present speaker, there are features which provide a considerable improvement in the efficiency which can be realized for a given enclosure volume and bandwidth. This has been accomplished by structure which significantly reduces the mass of the moving parts of the driver. Along with the mass reduction, it has been possible to reduce the electromagnetic drive required of the voice coil and magnet; which, in turn, extends the low frequency cutoff.

Considerable reduction in the moving mass is already accomplished in the speaker described by the referenced application. There a rib structure permits the use of a light cone paper. An edge roll and bearing provide novel front and rear suspensions of low friction and high compliance appropriate to the low mass of the cone.

In the speaker described herein, there are even further significant reductions of the moving mass. The cone and ribs are much lighter than in the speaker of the referenced application. A new low mass voice coil structure has been introduced. A novel configuration of ribs on the dust cap and speaker cone gives additional stability to the shape of the moving structure in the speaker. This is particularly important since the low mass coil structure tends to be quite flexible. Also important in this regard is the introduction of a resilient bearing on the coil structure that maintains the shape and alignment of the coil structure despite its flexibility.

An additional performance advantage provided by the speaker of the present invention is an improved transient response. This is a direct result of the decreased moving mass of the speaker, and the increased transmission velocities characteristic of the improved ribs.

In summary, the present invention provides a dynamic loudspeaker which can transduce substantially all of the audible spectrum, displaying, in addition, good efficiency, transient response, and power handling capability. The speaker has a magnetic center pole, with an extraordinarily light coil structure around it. A speaker cone of very low mass is coupled to one end of the coil structure, and there is a dust cap over that end of the coil structure. Sound transmitting ribs extend along the surface of the cone and the dust cap. The rear suspension of the speaker is provided by a bearing, which is on the coil structure and has a smooth surface resiliently disposed around the center pole to make sliding contact with it.

Another aspect of the invention is the combination of sound transmitting ribs with a speaker cone and protruding dust cover. The resulting unit has significantly improved rigidity and high frequency radiation characteristics when compared to corresponding units of conventional design and weight.

In accordance with another aspect of the invention, there is provided a novel rear suspension for an acoustic transducer having a coil structure around a magnetic center pole. The suspension is a bearing on the coil structure which has a smooth, resilient surface disposed around the pole to make sliding contact with it. More specifically, the bearing comprises a tape encircling and contacting the pole. The resulting suspension is highly compliant and permits large excursions of the coil structure. In addition, it conforms a very flexible and light weight coil structure to the pole.

In yet another aspect of the invention, there is disclosed a method for making a low mass coil structure with the novel bearing previously described. The method includes joining the ends of a strip of tape to form a cylinder having a first diameter. A strip of paper is formed into a cylindrical element concentric with, and contacting the tape. A voice coil is wound on at least one of the strips. The tape is heated to shrink one end of the cylinder to a second, smaller diameter, while maintaining the other end of the cylinder at the first diameter. The smaller diameter end provides the sliding surface for the bearing.

The nature of the invention, its features and advantages, as set forth above, may be understood more fully upon the consideration of particular embodiments. The following is a description of preferred embodiments and how to make and use them. It is to be read in conjunction with the accompanying drawings, wherein:

FIG. 4 is a detail, drawn to scale, of the section of FIG. 3, particularly showing the coil structure of the loudspeaker and the magnetic flux gap;

FIG. 5 is an expanded, partial section, to scale, showing the bearing on the coil structure;

FIG. 6 is an expanded section, to scale, of a rib on the speaker cone;

Figure 2:
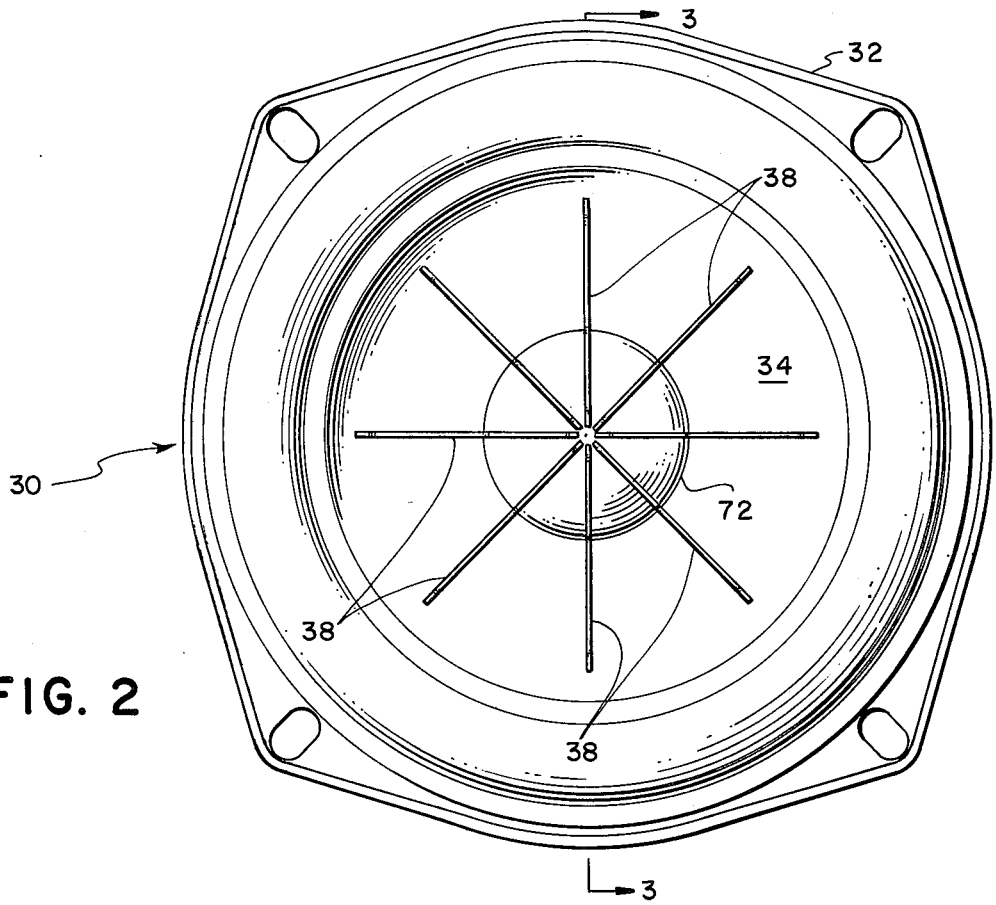
FIG. 2 is a frontal elevation of the loudspeaker.
Figure 1:
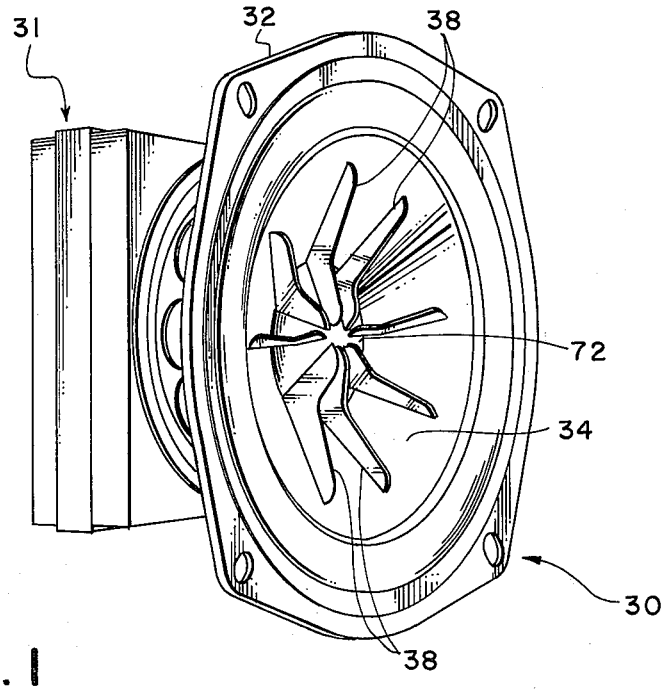
FIG. 1 is a perspective view of a loudspeaker according to the invention.

FIG. 1 illustrates the general exterior appearance of a loudspeaker in accordance with the invention. The speaker is indicated generally by the reference numeral 30. At the rear of the speaker is a magnetic assembly, indicated by reference numeral 31. Mounted on the magnetic assembly is the frame or "basket" 32 in which is suspended a paper speaker cone 34. Projecting from the cone and from a dust cap 72 are ribs 38. The distribution of the ribs 38 on the cone and dust cap are shown somewhat more clearly in the frontal view of FIG. 2.

Figure 3:
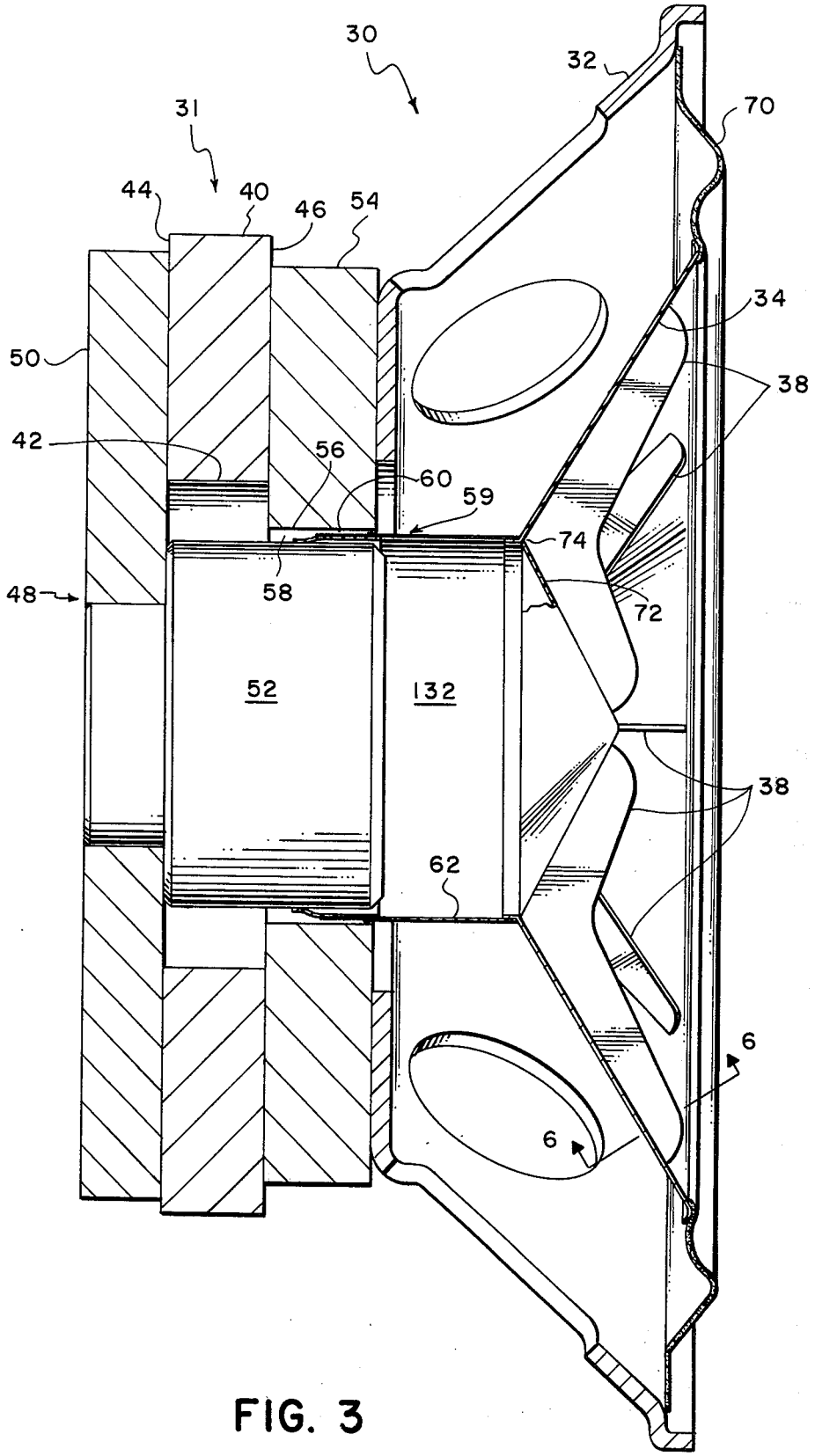
FIG. 3 is a sectional view showing internal features of the loudspeaker with the moving assembly shown near the forward limit of its normal excursion.

The internal structure of the speaker is shown in FIG. 3. The figure is substantially to scale. The magnetic assembly 31 is seen to be composed of three pieces. A magnetic plate 40 with a cylindrical aperture 42 is magnetized so that one pole is on surface 44 of the plate and the other pole is on surface 46. Pole piece 48 has a plate portion 50 adjoining magnetic plate 40 at surface 44, and a cylindrical center pole 52 which extends through aperture 42. A plate-shaped pole piece 54 adjoins magnetic plate 40 at surface 46. Pole piece 54 has a cylindrical aperture 56 through which center pole 52 extends. The lines of magnetic flux from magnetic plate 40 extend across surfaces 44 and 46, through the pole pieces 48 and 54, and across the annular air gap 58, which is between pole piece 54 and center post 52. In a preferred embodiment, the width of the air gap 58 is 0.048 inches, andthe diameter of the center pole is 1.4 inches. The moving parts of the speaker, i.e., the coil assembly 59 and cone assembly including the cone 34, dust cap 72 and ribs 38 are illustrated in a forward position of travel in FIG. 3 when compared to FIG. 4.

FIG. 4 illustrates a coil assembly, indicated generally by reference numeral 59, which moves in the air gap 58. The coil assembly includes coil 60, which is wound partially on a paper cylinder 62 and partially on a Teflon sleeve 64. The rear end of sleeve 64 is formed into a bearing portion 66 which contacts and slides upon center pole 52. Bearing portion 66 maintains the alignment of the coil structure 59 in air gap 58 and serves as the rear suspension system for the moving assembly of the speaker.

The manner in which bearing portion 66 contacts center pole 52 is further illustrated in FIG. 5. In that figure, the shape of bearing portion 66 was traced from a photograph, and the remainder of the figure drawn to scale. As illustrated by the cross section of FIG. 5, the bearing is circumferentially corrugated, forming a number of circumferentially spaced bearing surfaces 68 which contact and slide upon center pole 52. It can be seen that the area of contact of each bearing surface 68 is relatively small, both in the circumferential and the axial dimensions, the latter being for example, less than about 1/16 inch.

Referring again to FIG. 3, the cylinder 62 is bonded to the speaker cone 34. The periphery of cone 34 is attached to an annular rolled edge seal 70. The seal 70, which is preferably formed of polyurethane foam, is mounted along its outer periphery on basket 32.

The dust cap 72 is of a generally conical shape so that the peripheral edge 74 at the base of the conical surface is circular. This circular edge 74 is joined along its perimeter to speaker cone 34 by a suitable cement or adhesive.

Each of the ribs 38 is attached both to speaker cone 34 and to dust cap 72, and thus is coupled to the coil assembly. Each of the ribs 38 is planar and is preferably die stamped from sheet material. FIG. 3 shows exactly, for two of the ribs, the shape of the planar surface. FIG. 6 illustrates how the planar surface of each of the ribs 38 is mounted normal to the surface of the speaker cone 34 and of dust cap 72, and is also drawn to scale to illustrate the extreme axial dimension of the ribs with respect to the thickness of the ribs and the thickness of the cone. In a preferred embodiment, for example, the thickness of the ribs 38 is about 0.005 inch, the thickness of the cone 34 is about 0.005 inch, and the height of the ribs 38 is about 0.250 inch.

The speaker 30 is driven as other electrodynamic loudspeakers. An electrical current in coil 60 results in the motion of the unit which includes the coil structure 59, cone 34, dust cap 72, and seal 70. The moving assembly is maintained in the proper axial alignment by seal 70 at the forward end and the bearing 66 at the rear end.

FIGS. 7 through 19 illustrate the method of fabricating the coil structure 59, in accordance with the present invention. When the assembly is carried out by hand, it is facilitated by the use of a mandrel, and the following description is of such a method. It will be appreciated that the process may be automated, in which case the mandrel may be unnecessary or much simplified.

Figure 7:
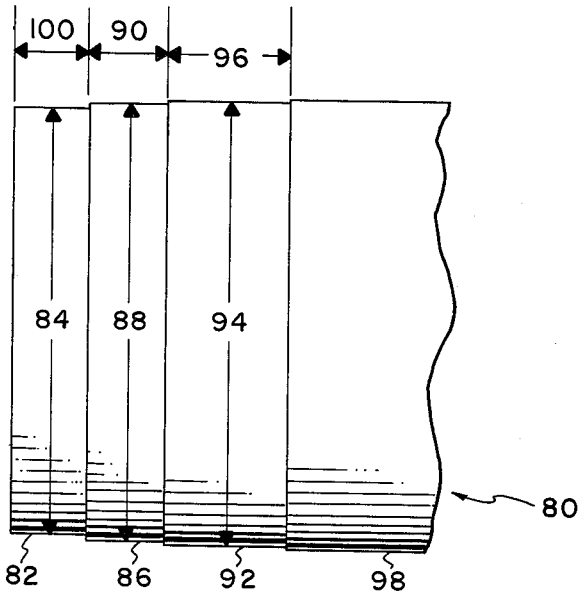
FIG. 7 is a side elevation of a mandrel used in the fabrication of the loudspeaker coil structure.

FIG. 7 shows a mandrel 80 which may be used in the method of the present invention. The mandrel 80 includes coaxial cylindrical surfaces 82, 86 and 92. In one embodiment of the invention, for example, the cylindrical surface 82 has a diameter indicated by reference numeral 84 and equal to 1.410 inches. The diameter 88 of cylindrical surface 86 is equal to 1.430 inches. The axial dimension 90 of surface 86 is 0.26 inches. The cylindrical surface 92 has a diameter 94 of 1.437 inches and an axial dimension 96 of 0.40 inches. The diameter of surface 98 need only be somewhat greater than dimension 94. The axial dimension 100 of surface 82 must be greater than 0.125 inches.

Figure 17:
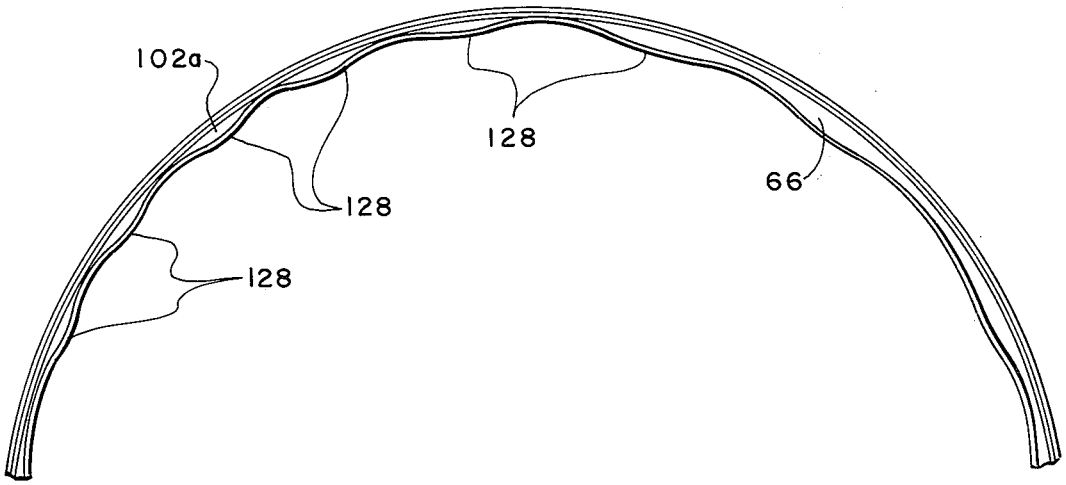
FIG. 17 is a partial rear elevation view of a completed coil structure.

Sleeve 64 with bearing 66 is formed from a strip of Teflon tape which is subjected to heat shrinkage. The Teflon tape employed may be either of the skived or extruded variety, and includes an adhesive on one surface. The tracings shown in FIG. 5 and below in FIG. 17 are of a bearing made from skived tape. The corrugations of bearing 66 as shown in those figures would be somewhat more pronounced for a bearing fabricated from extruded tape. A bearing made from the extruded tape tends to be somewhat more wear resistant, than that fabricated from skived tape.

With either type of tape, there is a problem in controlling the shrinkage precisely to prevent long term shrinkage which will result in excessive friction. It is preferable to use tensilized tape, that is tape that has been machine stretched. Most non-tensilized tape has too little potential for shrinkage. Before fabrication is begun, a sample of the tensilized tape is tested to determine its shrinkage properties, including the maximum possible shrinkage. The maximum must be equal to or in excess of the shrinkage desired in the fabrication of the bearing 66. The tape to be used in fabricating the coil assembly is then pre-shrunk by the amount of the excess, so that it will shrink the desired amount during the fabrication process.

Figure 8:
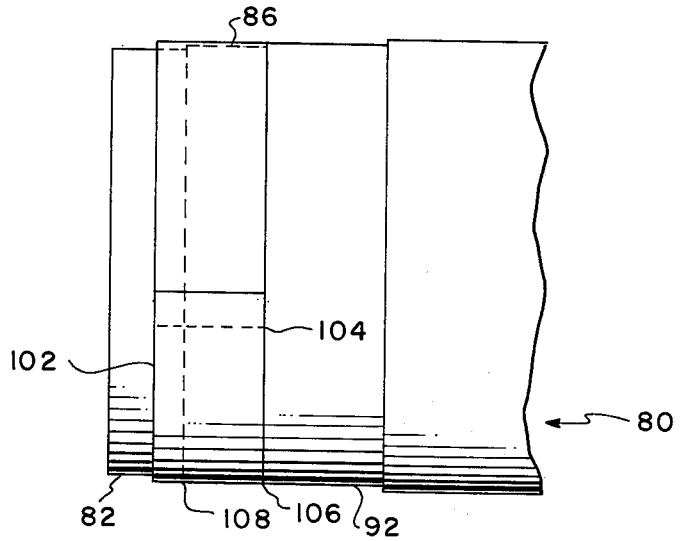
FIG. 8 is a side elevation view of the mandrel with a tape applied to it.

After the tape is pre-shrunk, a segment of it is wrapped around surface 86 of the mandrel as shown in FIG. 8. The tape 102 is placed with the adhesive side out with one edge against shoulder 106 and with an approximately 0.1 inch overlap, as indicated by hidden line 104. The tape is typically 0.375 inch wide so that when one edge is placed against the shoulder 106 between surfaces 86 and 92, the other edge overlaps the shoulder 108 between surfaces 86 and 82.

Figure 9:
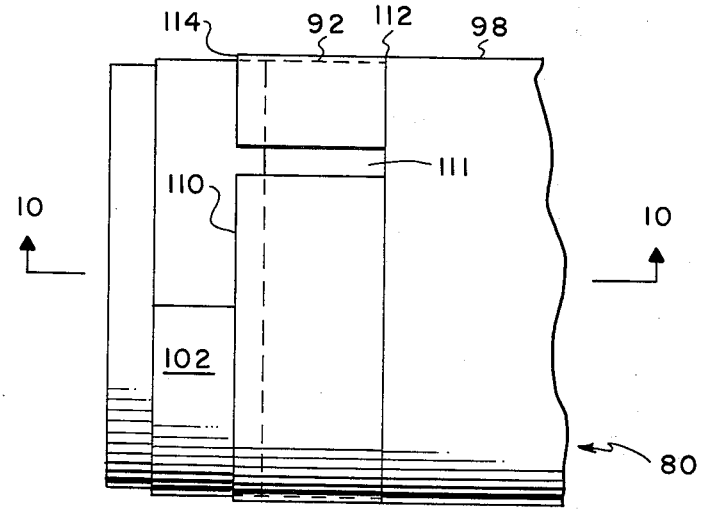
FIG. 9 is a side elevation view of the mandrel after a strip of paper has been applied with the tape.
Figure 10:
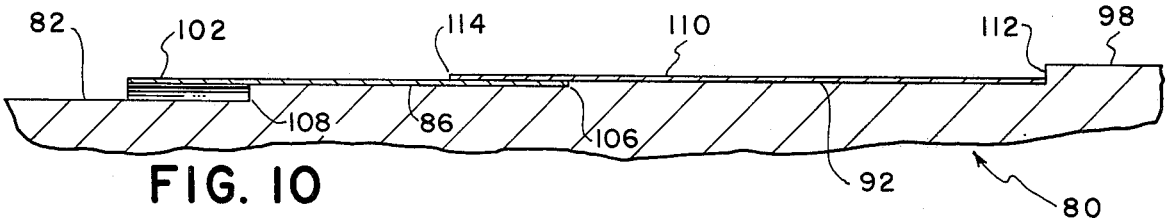
FIG. 10 is an expanded partial section showing the relationship of the paper and tape in FIG. 9.

As shown in FIG. 9, the next step is to wrap a strip of paper 110, which will become the cylinder 62, around surface 92. The paper is approximately 0.004 inch thick and is 0.45 inch wide. The paper 110 does not completely encircle surface 92, but leaves a gap 111 between the two ends of approximately 0.1 inch. When one edge of paper 110 is against the step 112 between surfaces 92 and 98, the other edge 114 overlaps the Teflon tape 102. As shown in FIG. 10, step 106 corresponds to the thickness of the tape 102, namely 0.0035 inch, so that the paper 110 extends smoothly over tape 102 and adheres to the exposed adhesive surface of that tape.

Figure 11:
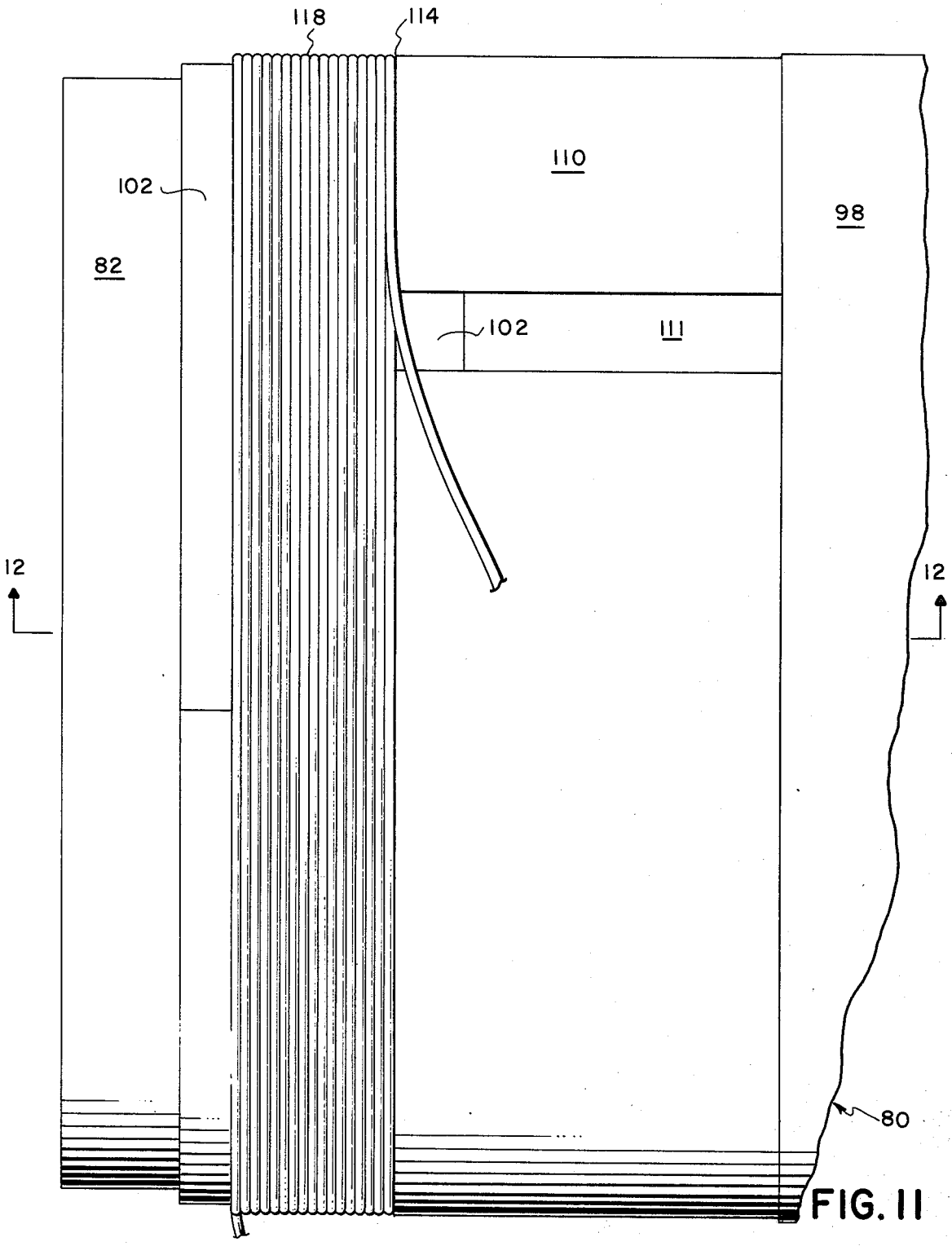
FIG. 11 is a side elevation view of the mandrel after the voice coil has been partially wound.
Figure 12:
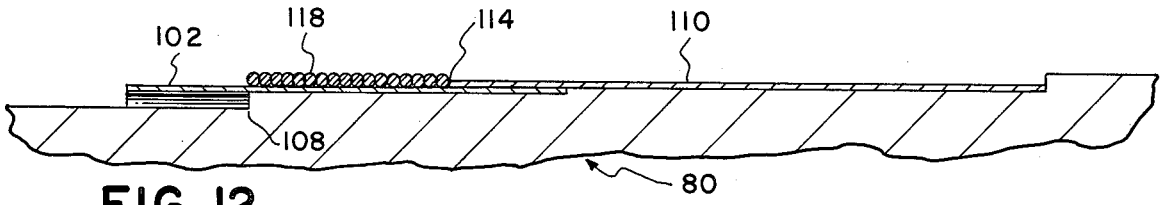
FIG. 12 is an expanded partial section further illustrating the winding shown in FIG. 11.

The next step, as shown in FIGS. 11 and 12, is to begin winding coil 60. The conductor used is 34 gauge copper-coated aluminum wire, which is approximately 0.0055 inch in diameter. The winding begins at the edge 114 of paper 110 at gap 111. The wire is then wound proceeding to the left in a single layer for seventeen turns, each turn touching the last. The last turn is near step 108.

Figure 13:
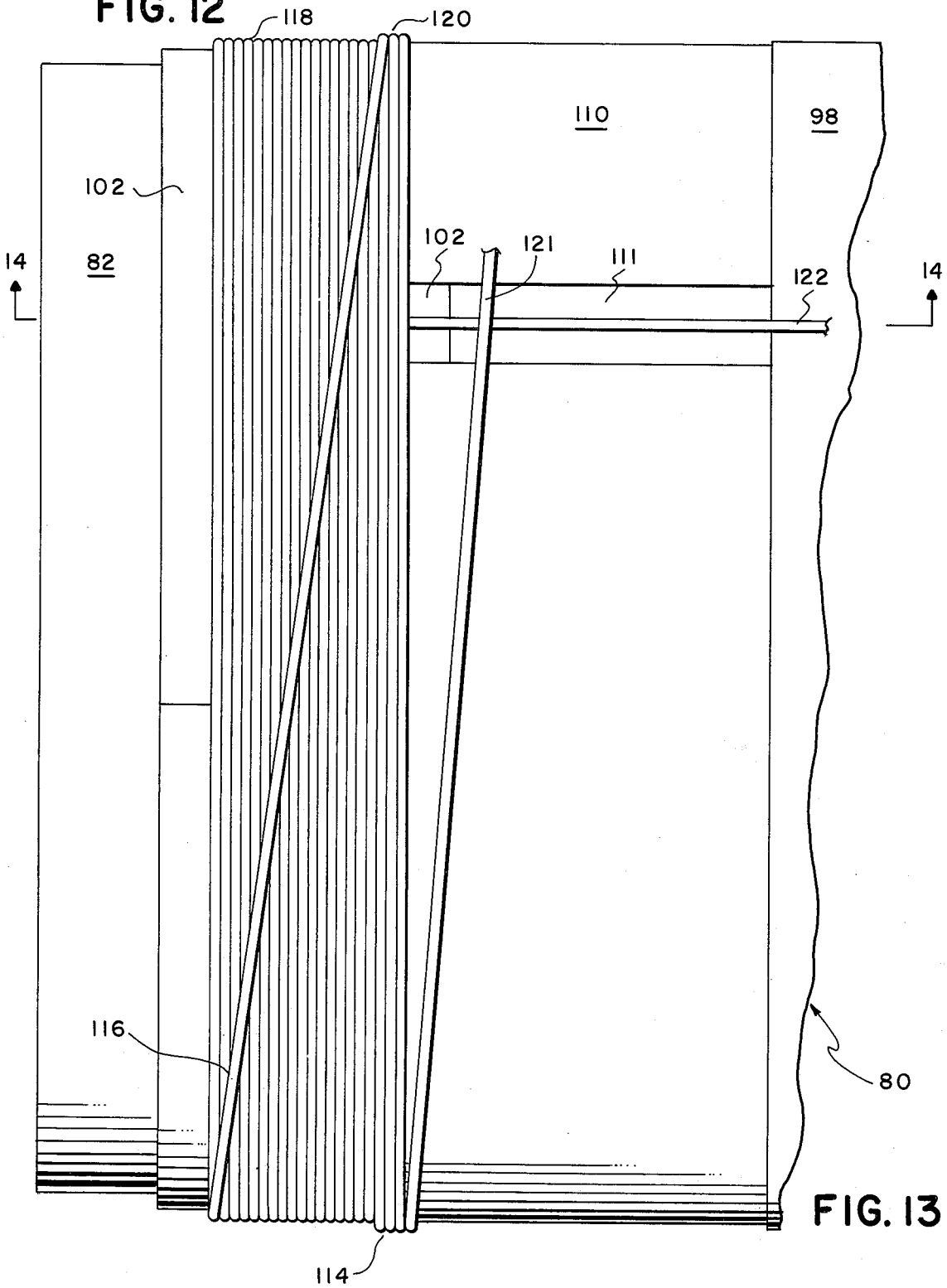
FIG. 13 is a side elevation view of the mandrel after the voice coil has been completely wound.
Figure 14:
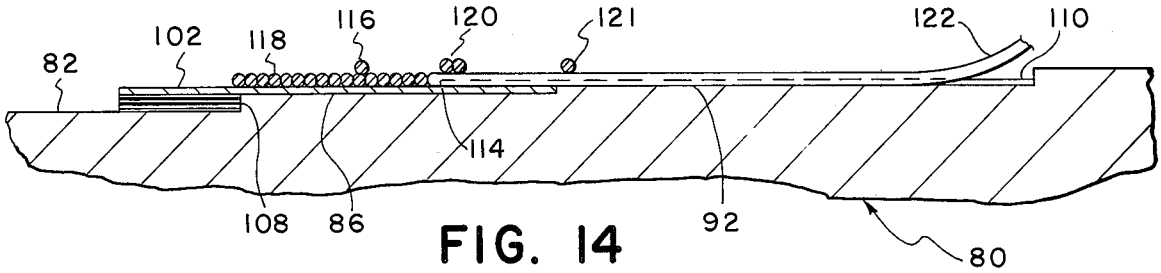
FIG. 14 is an expanded partial section further illustrating the winding shown in FIG. 13.

As illustrated in FIGS. 13 and 14, a half turn 116 is then brought back across the existing turns 118 and two and one-half turns 120 are wound over the paper 110 beginning at edge 114 and moving to the right. The resulting twenty turn coil is suitable for use in a four ohm speaker. Preparing for the next step, end 122 of the wire is bent to lie in gap 111 between the ends of the paper 110. It can be seen from FIG. 14 that if end 122 did not lie in gap 111 but on the paper 110, the thickness of the structure in the vicinity of turns 120 would be greater. The turns 120 serve to hold paper 110 and end 122 of the wire during the remainder of the fabrication process. In the completed structure, the turns 120 contribute to the mechanical attachment and intercoupling of the Teflon sleeve 64, the windings of coil 60, and paper 110.

Figure 15:
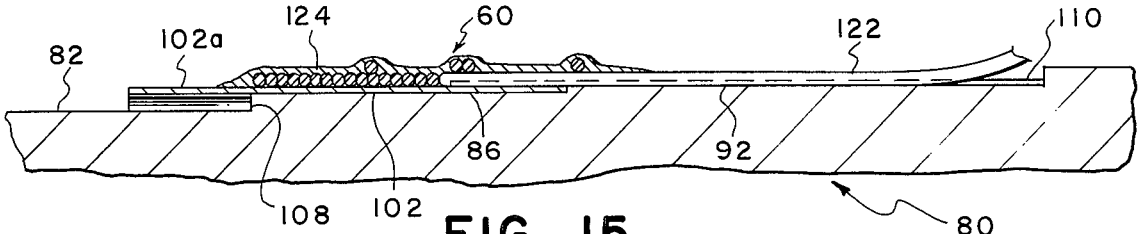
FIG. 15 illustrates the application of adhesive to the structure of FIG. 14.

Next the assembly is coated with a conventional epoxy 124, or other suitable material, as illustrated in FIG. 15. The epoxy 124 used must adhere well to the varnish on the wires, to the paper 110, and to the adhesive on the Teflon tape 102. It is important that the adhesive side of tape 102 be on the outside, for the epoxy adheres much better to the adhesive side. The assembly, while still on the mandrel is then placed in an oven and heated until the epoxy is cured and the Teflon tape has shrunk into the desired shape.

Figure 16:
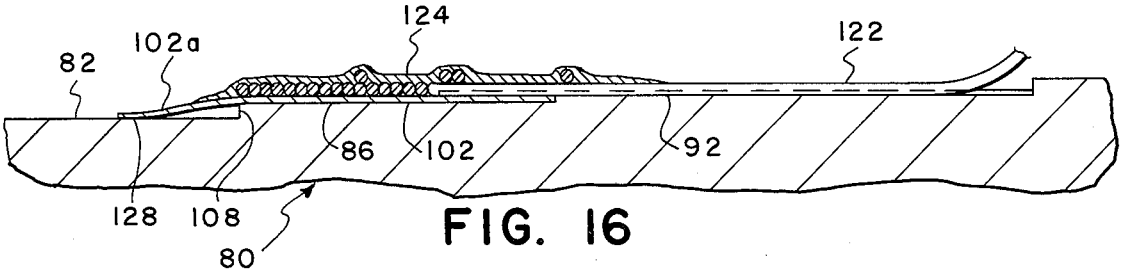
FIG. 16 illustrates the effect of heat treatment on the structure of FIG. 15.

Successful curing of the epoxy and shrinkage of the Teflon have been obtained using 225° F. for eight hours or 200° F. for sixteen hours. FIG. 16 shows the shrinkage that occurs in tape 102 when the coil assembly is heat treated.

After the epoxy 124 is cured, it should be hard. In a conventional coil, the wires adhere to a stiff coil form which transmits the motion of the wires in the axial dimension. In speaker 30, the motion of the wires must be fully coupled to the paper cylinder 62, which then transmits the motion to the speaker cone 34. In the configuration of FIG. 15, many of the wires of coil 60 adhere only to themselves and to the Teflon tape 102, which is flexible and does not transmit high frequency motion well. Thus, the transmission of motion, particularly for high frequencies, is primarily from one wire to another and through the epoxy 124, and for this reason the epoxy should be hard. An epoxy which has been found to provide the necessary adhesion and hardness when heat cured is that made from Quadrant Chemical Corporation resin A2001 and hardener B-2079.

FIG. 17 is a tracing of a photograph of a coil structure 59 after removal from the mandrel, clearly showing the corrugations in bearing 66. The points 128 of greatest deflection are the areas where the shrunken tape is shown touching the mandrel in FIG. 16. There were twenty-four such points in the sample photographed. They form the bearing surfaces 68 which contact the center post 52 when the coil structure 59 is installed, as illustrated in FIG. 5.

Surface 82 of the mandrel 80 is 1.410 inches in diameter, and it is this diameter to which the tape 102 conforms after heat treatment. The center pole 52 of the completed speaker has a somewhat smaller diameter, 1.400 inches. This does not mean, however, that the bearing 66 stands away from center pole 52 since the corrugations in the bearing are slight at the conclusion of the heat treatment, but become deeper after removal from the mandrel and with passage of time, until they conform to the smaller diameter of center pole 52.

It will also be noted that the epoxy 124 is not spread over the very end of the Teflon tape **102*a* to allow the portion 102*a* of the tape to freely shrink and become corrugated. The corrugations provide self-conforming bearing surfaces of limited areas on the post. More importantly, the combination of the corrugations and the tape which is not coated with epoxy is highly resilient and provides a more noise free bearing system. The corrugations are believed to be the result of shrinking the tapes over the shoulder 108**.

Figure 18:
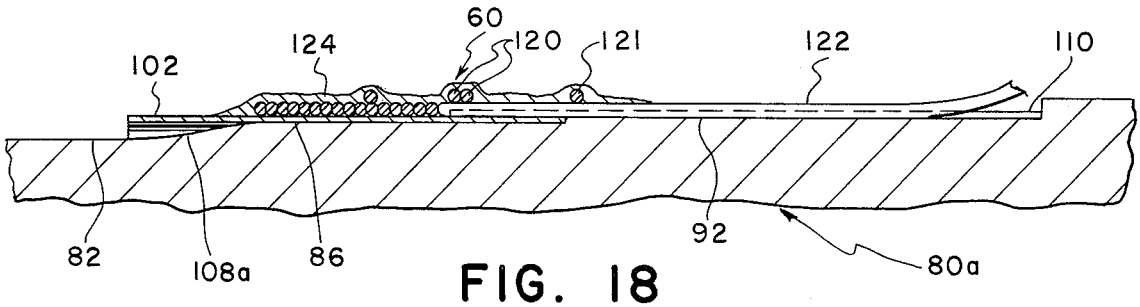
FIG. 18 is an expanded partial section comparable to FIG. 15, but illustrating an alternate embodiment of the method and coil assembly of the present invention.

An alternative embodiment of the method of the present invention is illustrated in the sectional view of FIG. 18. It will be noted that FIG. 18 is similar to FIG. 15, and illustrates the state of the assembly just prior to heat treating to cure the epoxy and shrink the Teflon tape. Accordingly, corresponding components in FIG. 18 are designated by the same reference characters as in FIG. 15. However, the mandrel 80a in FIG. 18 is different from the mandrel 80 in FIG. 15 in that a tapered section 108a extends between surfaces 86 and 82, rather than abrupt step 108. The taper 108a may be of any desired shape to control the contour of the tape 102 after it is heat treated and shrunk around the mandrel. The use of the tapered section 108a provides a means for controlling with greater precision and repeatability the ultimate configuration of the section of the Teflon sleeve 102a which forms the bearing surface. More importantly, the depth of the corrugations can be controlled by the configuration of the mandrel between cylindrical surfaces 86 and 82. Other configurations of the mandrel between surfaces 86 and 82 can be used. For example, the tapered configuration can be approximated by a series of right angle steps of the type used on the mandrel 80. The extent of the corrugations formed in the bearing appear to primarily be the result of the abruptness with which the tape is caused to transition from the relatively large diameter 86 to the smaller diameter 82 and the length of Teflon material extending outwardly along the smaller diameter surface 82. It is desirable, although not completely essential, to have some corrugations since these reduce the area of sliding contact and also provide a more resilient structure between the coil assembly and center pole. On the other hand, by shortening the axial length of Teflon tape in contact with the post, the contact area can also be reduced even though a greater circumferential proportion of the bearing contacts the post, even to the extent that the bearing surface appears to the naked eye to be cylindrical and to touch around substantially the entire periphery of the post. In the latter case, the resilience of the portion of Teflon tape extending behind the coil and epoxy still provides the desired resiliency between the center pole and coil assembly and the axial length of the contact is reduced sufficiently to provide a low level of friction.

Figure 19:
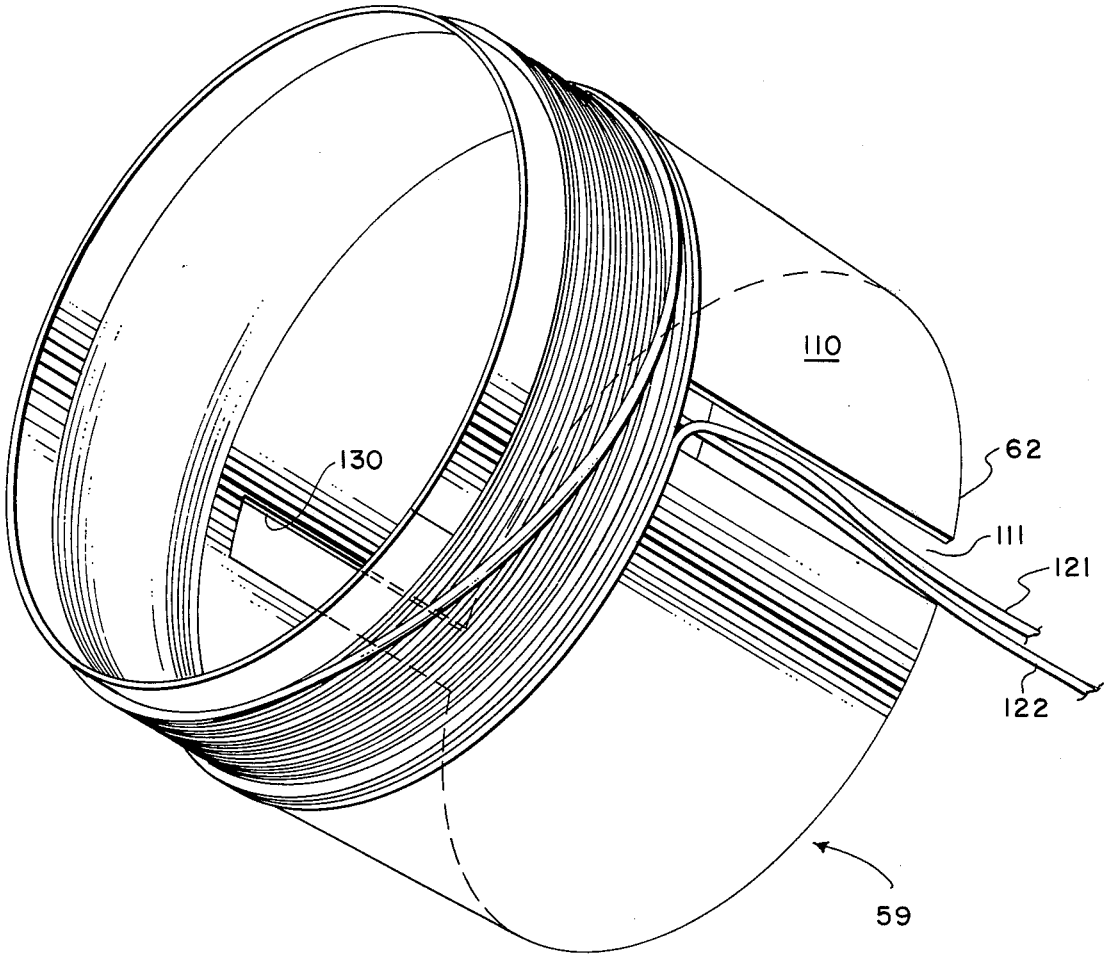
FIG. 19 is a perspective view of a completed coil structure.

A completed coil structure 59 is illustrated in FIG. 19. Several additional details of the structure can be seen in that figure. Wire end 121 has been pulled away from its epoxy attachment to paper 110, and bent so as to lie in gap 111 along with wire end 122. In the completed speaker, wires 121 and 122 leave gap 111 at the junction of cylinder 62 and speaker cone 34 and are brought in a conventional manner to points of connection on speaker cone 34. It can also be seen that there is a gap 130 in coil form 62 diametrically opposite gap 111. Referring to FIG. 3, it can be seen that there is an air space 132 enclosed by the coil structure 59, dust cap 72 and center pole 52. The air space 132 experiences rapid changes in volume during the operation of the speaker; and the gaps 111 and 130 provide balanced air flow into and out of air space 132. The gap 130 may be cut in the strip of paper 110 before or after the fabrication of coil structure 59, depending on convenience.

In the overall performance of the speaker 30, its most distinctive characteristic is the achievement of an extended frequency response by a single driver. Speakers have been fabricated as described above with a frequency response of 70 Hz to 15,000 Hz when installed in a 450 cubic inch acoustic suspension enclosure, or from 45 Hz to 20,000 Hz in a 950 cubic inch enclosure. The speaker is also quite efficient. For example, it can generate a 90 db sound level at one meter, driven by one watt. Further, it provides a freedom from forms of distortion present in conventional wide range speaker systems. Important to all of these performance criteria, but particularly important to the efficiency of the speaker is the extraordinary low mass of the moving unit of the speaker.

The moving mass of the speaker described in the above referenced application was quite low compared with conventional speakers capable of producing bass notes. However, in the design of that speaker, reduction of the mass below a certain point became counterproductive. This is because the speaker was designed to operate in a very small acoustic suspension enclosure, about 220 cubic inches. When the cone of a speaker tries to move against the air in such an enclosure, it is as though it were pushing against a relatively stiff spring. The large stiffness tends to produce a resonant frequency for the speaker system that is higher than the low frequency cutoff of the driver. This unduly limits the bass response of the system. One way to lower the resonant frequency of the system is to employ a higher moving mass. Therefore, in the previous speaker, reductions of the moving mass in pursuit of efficiency were limited, in order to achieve a suitable resonant frequency.

The present speaker 30 is designed for use in an acoustic suspension enclosure which is larger, for example 450 cubic inches, and therefore exhibits considerably lower stiffness. Here the attempt was made to reduce the mass of the moving unit, exclusive of coil 60 to a minimum. Then the number of turns in the coil 60 and its current capacity were decreased to correspond to the lower mass load. The reductions in mass increased the efficiency of speaker 30, while the reductions in electrodynamic drive provided the benefit of extending the low frequency response of the driver. The moving mass in speaker 30 is approximately two grams, as contrasted with six to ten grams for a typical 5.25 inch midrange speaker of conventional design.

It is understood in the art of designing speaker systems that the selected enclosure volume and low frequency cutoff of the system determine the efficiency which can be theoretically realized from the system("-'Fundamentals of Loudspeaker Design", M. Lampton and L. M. Chase, Audio, Dec. 1973, p. 40). Further, reducing the mass of the moving structure of a conventional speaker reduces its ability to handle power, because of an increase in temperature of the voice coil during operation, because of break up of the cone, and because of the limits of linear excursion of the suspension system of the cone. The innovations of speaker 30 increase the efficiency which can be actually achieved for a chosen low frequency limit, enclosure size, and power handling capability. The lowered inductance of the voice coil, coupled with the special transmission characteristics of the ribs, and the decrease in overall mass of the moving component of the speaker results in an extension of this more efficient performance to the upper limits of the audible frequency spectrum, thus effectively extending the bandwith of the loudspeaker.

Several factors contribute to the lower moving mass of the present speaker. A lighter cone 34 is employed, made of 0.005 inch thick paper. The ribs 28 are made of 0.005 inch thick Mylar. All parts of the coil structure 59 are exceptionally light, the coil, Teflon and paper. A conventional coil form might, for example, use paper 0.02 inch thick, as contrasted with the 0.005 inch thick paper in coil form 62.

Two structural features contribute to the low mass of the coil structure 59. First, it is wound with copper-covered aluminum wire instead of the conventional solid copper wire. Second, it is wound in a single layer instead of the conventional two or four-layer configurations. Since the heat dissipating capability of a coil is dependent on its exposed surface area, a single layer coil of a given diameter and width in the axial dimension will have at least the same power rating as a multi-layer coil of these same dimensions. If the coils are to have the same total resistances, the single layer coil will be made with wire of a smaller cross section and fewer total turns; therefore, it will be lighter. For example, it is possible to design a single layer coil having the same coil diameter, width, electrical resistance and power dissipation ability as a double layer coil, yet with only 40% of the mass of the two layer coil. Relevant to the design of the present speaker 30 that the single layer coil is considerably more flexible structurally than that using multiple layers, thus significantly contributing to the fit of the bearing on the post during fabrication and operation of the speaker.

An important variable in the design of the coil is its diameter. For a coil with a given length of wire, its width in the axial dimension may be decreased by increasing the coil diameter. This makes the coil more compact, in the axial dimension, with respect to the magnetic field in which it reciprocates. The coil diameter in the present speaker 30 is unconventionally large with respect to the size of cone 34, which also makes the coil more flexible.

The thin materials of coil structure 59, its single layer winding and large diameter all result in a relatively flexible structure. This is true even considering the stabilizing effect of ribs 38 and dust cap 72, described below. If coil structure 59 were used with a conventional rear suspension, distortions of the structure 59 would tend to produce rubbing of the coil 60 against pole piece 54 or center pole 52. In the speaker 30, however, bearing 66 can maintain proper alignment of coil 60 in the air gap 58, including maintaining the coil assembly round.

If the coil structure 59 is in an unflexed condition with a substantially perfect cylindrical shape, then it is held in position between center pole 52 and pole piece 54 by the unstressed shape of the bearing 66. If the coil structure 59 begins to distort out of round, some portions of it move toward pole piece 54, while other portions move toward center pole 52. Bearing 66 resiliently limits the motion toward pole 52. The effective diameters of bearing 66 and coil structure 59 are such that if the structure 59 assumes the most elliptical possible shape about pole 52, the coil structure cannot touch outer pole piece 54. For bearing 66 to perform this function adequately, its size and shape must be closely controlled. The fabrication process described in connection with FIGS. 7–19 provides the requisite control.

When the coil structure 59 is in motion, there is no significant noise generated by impact between bearing 66 and center pole 52, because of the softness, resilience and smoothness of the bearing.

Bearing 66 adequately achieves the low frictional forces sought in the sliding operation. This is partially the result of the low friction Teflon material employed. However, it is also a result of the low contact area of the surfaces 68. In the design and fabrication of the bearing, there is a trade off between the axial and circumferential dimensions of surfaces 68, in order to obtain the desired contact area. For example, if bearing 66 is designed and built without corrugations, then the axial dimension of its contact area must be made smaller than herein illustrated.

To achieve high compliance of the cone 34 it is desirable to minimize the coefficient of sliding friction of the coil assembly 59 on the center pole 52. The coil assembly 59 includes coil 60, which is partially wound on the paper cylinder 62 and partially on the Teflon sleeve 64. The rear end of the sleeve 64 is formed into the bearing portion 66 which contacts and slides upon the center pole 52. Low frictional forces for sliding engagement of the bearing 66 with the metal center pole 52 is provided by constructing the bearing 66 from a material having a significantly lower coefficient of friction than paper from which coil forms are conventionally made, such as Teflon. The coefficient of sliding friction of Teflon on steel is typically 0.04. Although Teflon is the preferred material for constructing the bearing 66, other materials having a low coefficient of friction compared to paper may be used to good advantage.

In a conventional speaker, the rear suspension or "spider" exerts a restoring force on the cone as it moves farther from its neutral position. Thus, it is an additional element of stiffness in the moving portion of the speaker. Moreover, it places a limitation on very large excursions of the cone, as in the generation of loud bass notes. It will be apparent that the sliding operation of bearing 66 both eliminates this component of stiffness and permits very long cone excursions without non-linear restoring forces. A conventional rear suspension providing adequate compliance and length of linear cone travel would have a diameter much larger than that of cone 34. It would thus be incompatible with the general design requirements of the speaker 30.

The functions of ribs 38 as they extend across cone 34 are described in considerable detail in the referenced application, but they will be summarized here. For low frequency operation, the ribs allow a very light cone structure to attain a rigidity which is otherwise possible only by using a heavy, stiff paper cone. The rigidity prevents buckling of the cone during large low frequency excursions and minimizes spurious modes of vibration in the cone. At high frequencies, each rib couples the high frequency energy from paper cylinder 62 to cone 34 all along the base of the rib. The resulting wavelets of acoustical energy radiated at various points along one of the ribs 38 are substantially in phase with one another, minimizing cancellation effects. The amount of high frequency energy radiated can be adjusted by varying the number of ribs, the length of the ribs, and the height of the ribs, i.e., the axial dimension of the ribs.

The portions of the ribs 38 that lie on dust cap 72 perform at least two functions. First, they transmit high frequency energy to dust cap 72 in the same manner as it is transmitted to cone 34. The result is to increase the effective high frequency radiating area. Second, when the ribs 38 are extended onto the dust cap 72, the structure composed of cone, ribs and dust cap becomes a considerably more rigid unit. This is particularly important because the flexible coil structure 59 is not the source of structural stability that a conventional stiff coil form would be. Referring to FIG. 3, it can be seen that there is some opportunity for the flexible wall of coil structure 59 to move in rotation about edge 74. If this happens, the nearby portion of cone 34 tends to rotate in the same direction about the edge 74. The portion of ribs 38 on dust cap 72 oppose this motion. If dust cap 72 were flat rather than conical, the rigidity attained would not be as great. The forces on the flat dust cap would be largely normal to its surface, and it would readily bend to them. In the protruding configuration shown, if a portion of the cone 34 tends to rotate about edge 74, the movement is opposed by stretching forces in the plane of the material near the apex of the conical dust cap 72.

It is envisioned within the broader aspects of this invention that the cone 34, dust cap 72, and ribs 38 may not be fabricated separately and assembled as generally described herein. Any two or all three of these categories of items may be fabricated as a unit. They may be molded of plastic or perhaps stamped from a material such as Mylar.

The term "Teflon" as used herein refers to that class of materials described in *The Condensed Chemical Dictionary* and characterized by the well known low coefficient of friction of from about 0.04 to about 0.08. The term Mylar is a trademark of DuPont and as used herein refers to that class of polyester films widely used for electrical insulating, packaging and other industrial purposes.

Copper-clad aluminum wire is used in the described embodiment only to facilitate soldering the ends of the wire to conventional flying leads. The copper can be eliminated and insulated aluminum wire used if not needed for this type connection.

Although preferred embodiments of the invention have been described in detail, it is to be understood that various changes, substitutions, and alterations can be made therein without departing from the spirit and scope of the invention as defined by the appended claims.

What is claimed is:

1. A loudspeaker comprising:

a magnetic assembly forming an annular flux gap around a center pole having a smooth surface, a tubular coil assembly disposed around the center pole and including bearing means having a smooth bearing surface resiliently mounted on the coil assembly and in sliding contact with the center pole, a cone assembly coupled to one end of the coil assembly including a dust cap portion over said end of the coil assembly and a cone portion extending outwardly from the coil assembly, and a plurality of rib members extending radially outwardly from the center of the dust cap portion along and continuously coupled to the surface of the dust cap portion and along and continuously coupled to the surface of the cone portion.

2. A loudspeaker as described in claim 1, wherein the coil assembly includes a cylinder of paper less than 0.008 inch thick and a voice coil of wire weighing less than 0.04 grams per foot, and wherein the speaker cone is formed of paper less than 0.007 inch thick.

3. In a loudspeaker, the combination comprising:

a magnetic assembly for producing an annular flux gap around a cylindrical center pole, a flexible tubular coil structure around the center pole, and bearing means disposed around the center pole on the coil structure for maintaining the flexible coil structure in a tubular shape and radially aligned in the flux gap by contact of the bearing means with the center pole.

4. The combination of claim 3 wherein the flexible coil structure includes a single layer voice coil.

5. The combination of claim 3 further including a speaker cone coupled to one end of the coil structure, said bearing means being at the other end of the structure, and wherein said coil structure includes a voice coil adjacent the bearing means.

6. The combination of claim 3 wherein the coil structure includes a voice coil of aluminum wire.

7. The combination of claim 3 wherein the bearing means includes a smooth surface resiliently disposed in sliding contact with the pole.

8. The combination of claim 3 further including a speaker cone coupled to one end of the coil structure, a dust cap over said end, and a plurality of ribs extending along the surface of the dust cap and of the cone, whereby both the presence of the cone and dust cap and the contact of the bearing means with the center pole impart stability to the shape of the coil structure.

9. A loudspeaker having a coil structure disposed around a magnetic center pole, a bearing means on the coil structure comprising a thin, resilient, arcuate strip having a smooth surface in sliding contact with the pole, whereby the coil structure may move in spaced relation to the pole.

10. The loudspeaker of claim 9, wherein said arcuate strip has circumferential corrugations forming a plurality of circumferentially spaced smooth surfaces in sliding contact with the pole.

11. The loudspeaker of claim 9, wherein said strip is a Teflon tape.

12. In an acoustic transducer, the combination of:

a magnetic assembly having an annular flux gap formed between a cylindrical center pole having a free end and an outer pole disposed around the center pole, the cylindrical center pole having a constant diameter for at least the length of the flux gap and no greater diameter than the constant diameter between the flux gap and the free end of the center pole, the constant diameter forming a continuously cylindrical bearing surface extending into the flux gap;

a coil assembly including a voice coil wound on a tubular coil form and reciprocally disposed in the flux gap, the coil form having an internal diameter greater than the center pole to place the coil assembly approximately in the center of the flux gap, and having an internal bearing surface only at the end of the voice coil remote from the means forming the radiating surface, the bearing surface being continuously in sliding contact with the cylindrical bearing surface including a portion of the bearing surface within the flux gap to guide the coil form means relative to the magnetic assembly, the bearing surface having a very short axial length when compared to the axial length of the voice coil;

means forming an acoustic radiating surface attached to the end of the coil assembly beyond the free end of the center pole and reciprocated by the coil assembly when an electrical signal is passed through the coil; and means for providing a peripheral air seal between the radiating surface and a stationary baffle and radial support for the radiating surface.

13. In a loudspeaker, the combination comprising:

a magnetic assembly for producing an annular flux gap around a cylindrical center pole, a tubular coil disposed around and spaced from the center pole, and a continuous, thin, flexible bearing strip extending at least substantially around the center pole, extending axially from the coil, and extending radially inwardly from the coil into sliding contact with the center pole for maintaining the coil radially aligned in the flux gap.

14. In a loudspeaker, the combination comprising:

a magnetic assembly for producing an annular flux gap around a cylindrical center pole, and a tubular coil structure disposed around the center pole comprising:

a cylindrical member formed of a thin strip of flexible bearing material, the cylindrical member having a coil attachment portion of greater diameter than the center pole, the cylinder member having a bearing portion at one end of the coil attachment portion of a smaller diameter than the coil attachment portion and in sliding contact with the center pole, and a coil disposed around and attached to the coil attachment portion.

15. The combination of claim 14 further comprising:

a second cylindrical member disposed around the first cylindrical member and attached to the first cylindrical member adjacent the coil and on the opposite side of the coil from the bearing portion for connecting the coil structure to the cone of the loudspeaker.

16. A loudspeaker having a coil structure disposed around a magnetic center pole, a bearing means on the coil structure comprising a thin, resilient, generally frustoconical portion tapering from a larger diameter to a smaller diameter, with the smaller diameter having a surface in sliding contact with the pole, whereby the coil structure may move in spaced relation to the pole.

17. The loudspeaker of claim 16 wherein the frustoconical portion is continuous around at least a substantial portion of the center pole.

18. A loudspeaker having a coil structure disposed around a magnetic center pole, the coil structure comprising a first cylindrical member formed of a thin sheet of bearing material, the first cylindrical member having a substantially constant diameter greater than that of the center pole over a major portion of its length and having one end portion tapering inwardly to engage the pole in sliding contact, a coil of wire disposed around and contacting the substantially constant diameter portion and attached thereto, and means for connecting the other end of the first cylindrical member to a loudspeaker cone.

19. The loudspeaker of claim 18 wherein the means for connecting the other end of the first cylindrical member to a loud speaker cone comprises a second cylindrical member formed of a strip of paper disposed around the other end of the first cylindrical member and attached thereto.

20. The loudspeaker of claim 18 wherein the first cylindrical member is formed by a tape of Teflon having a coat of adhesive which will adhere to Teflon on the outside surface of the cylinder, the wires are disposed directly on the adhesive, and the wires are encapsulated in an epoxy which is adherent to the adhesive and to the wires.

21. The loudspeaker of claim 20 wherein the first cylindrical member is formed by a strip of the tape overlapped at the ends and joined by the adhesive on one of the ends.

* * * * *

UNITED STATES PATENT OFFICE

CERTIFICATE OF CORRECTION

Patent No. 4,115,667 Dated September 19, 1978

Inventor(s) Burton A. Babb

It is certified that error appears in the above-identified patent and that said Letters Patent are hereby corrected as shown below:

Column 1, line 11, "convention" should be —conventional—.

Column 3, line 64, "andthe" should be —and the—.

Column 10, lines 7-23, paragraph should be deleted.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*